United States Patent [19]

Erlandson

[11] 4,009,875

[45] Mar. 1, 1977

[54] FLETCHING JIG

[76] Inventor: Roger S. Erlandson, Rte. 2, Box 2185, Elk Grove, Calif. 95624

[22] Filed: Aug. 13, 1976

[21] Appl. No.: 714,029

[52] U.S. Cl. ..... 269/38

[51] Int. Cl.[2] ..... B25B 1/20

[58] Field of Search ..... 269/38, 130, 131, 296, 269/321 A

[56] References Cited

UNITED STATES PATENTS

| | | | |
|---|---|---|---|
| 1,648,376 | 11/1927 | Blodgett | 269/38 |
| 3,322,421 | 5/1967 | Sisty | 269/38 |
| 3,338,772 | 8/1967 | McWherter | 269/38 |

*Primary Examiner*—Al Lawrence Smith
*Assistant Examiner*—Robert C. Watson
*Attorney, Agent, or Firm*—Donald E. Nist

[57] ABSTRACT

An improved arrow fletching jig for use with a multi-vane fletch, preferably a two-vane fletch, having a bridge between adjacent vanes comprises an upstanding jig block having an upper surface adapted to support an arrow shaft, and also the bridge of such multi-vane fletch against the shaft for proper bonding and fletching. The block upper surface preferably is grooved and inclined down towards a vertical post spaced from the block and bearing preferably vertically adjustable means for releasably holding the nock end of the arrow to be fletched. The spacing between the post and block can also be adjusted to accommodate various arrows and fletches. The sides of the block preferably diverge from the block's upper surface at an angle about equal to the angle between adjacent fletch vanes when the vanes are properly aligned with the shaft. Thus, the block sides support these vanes while the block upper surface supports the bridge between the vanes. A strap or the like may be used to press the shaft into the fletch bridge when overlying it on the block upper surface. The device is simple, inexpensive, durable and highly efficient and is adjustable for fletches of the type described.

10 Claims, 10 Drawing Figures

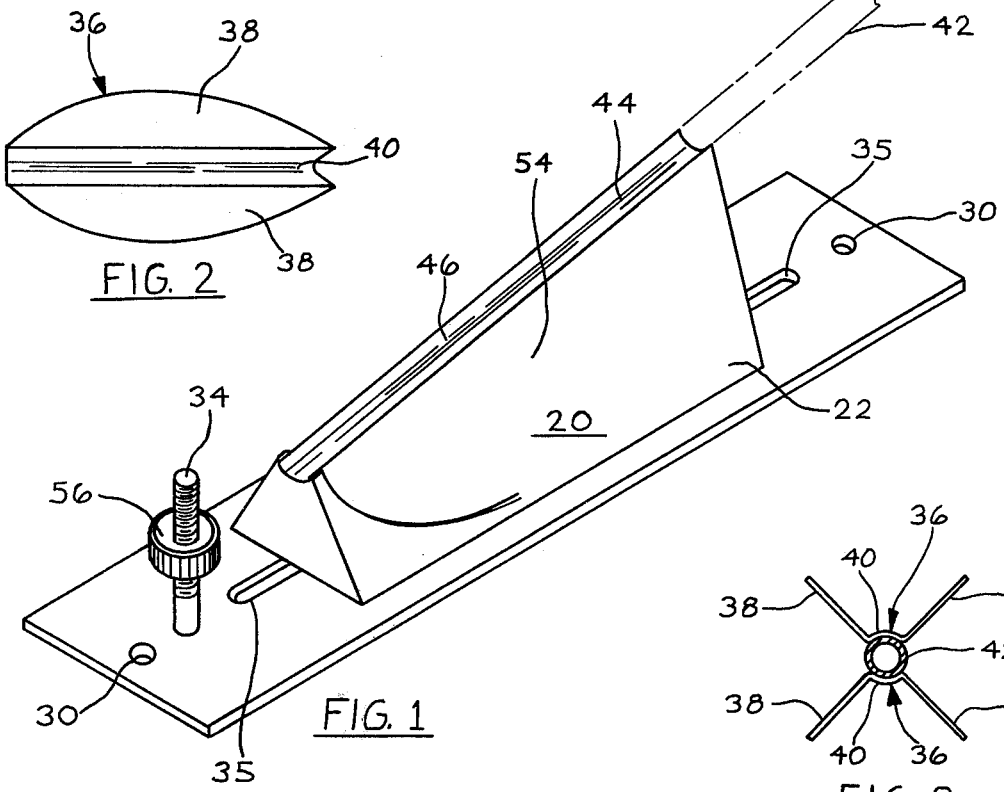
FIG. 2
FIG. 1
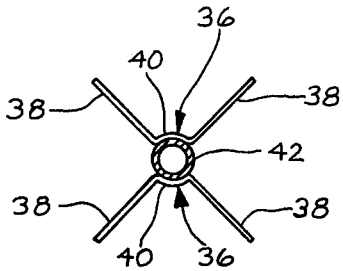
FIG. 3
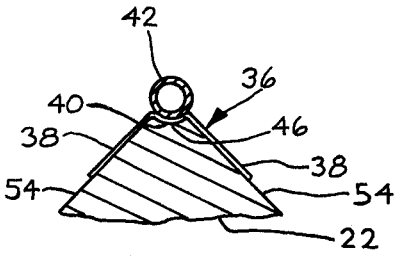
FIG. 6
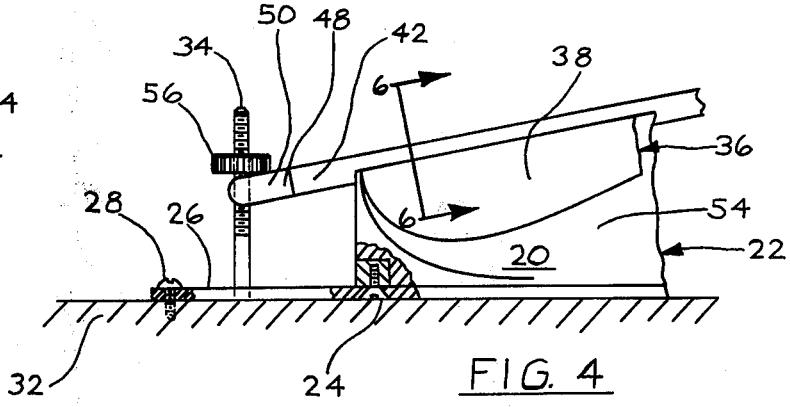
FIG. 4
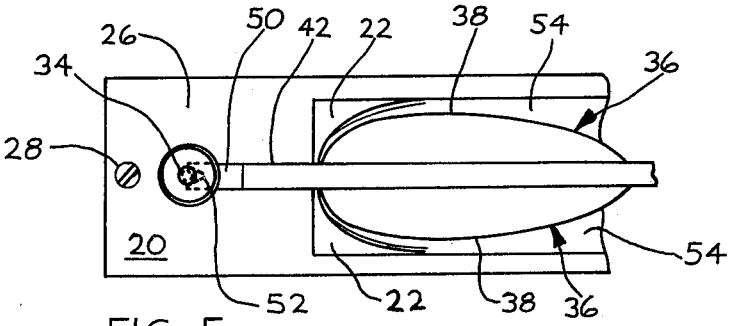
FIG. 5

FLETCHING JIG

BACKGROUND OF THE INVENTION

1. Field of the Invention

The present invention generally relates to sports devices and more particularly relates to improved apparatus or jigs for fletching multi-vane fletches onto arrow shafts.

2. Prior Art

Fletching jigs are conventionally employed to properly position single arrow vanes, one at a time, against arrow shafts while glue, cement or another bonding agent which has been applied to the base of the vane sets and bonds the vane to the shaft. Such vanes may be of feather, plastic, rubber, foil or the like and usually become damaged during use of the arrow and must be replaced from time to time. The fletching procedure is slow and the jig is usually sufficiently imprecise and difficult to use so that it provides varying results. The particular location of vanes on the arrow shaft can affect arrow flight and the point of impact of the arrow on the target. Therefore, duplication of fletching results from vane to vane and arrow to arrow is important for accurate shooting, something every archer strives for. Saving of time in fletching arrows is also much to be desired. A considerable time investment is involved, since for each dozen of arrows usually 36 or 48 vanes must be separately and tediously applied. Accordingly, reduction of arrow fletching time and improvement in arrow fletching precision are being sought by archers.

SUMMARY OF THE INVENTION

The improved arrow fletching jig of the present invention satisfies the foregoing needs. It is substantially as set forth in the Abstract above. The jig is adapted for rapid and precise fletching of two or more arrow vanes at one time on an arrow shaft, when utilizing a multi-vane fletch, preferably a two-vane fletch having a bridge between adjacent vanes. The jig has repositional adjustable components so that it is adaptable to various arrow shaft and nock sizes and various fletch sizes. The jig includes an upstanding block upon which the fletch and vane rest for fletching. The jig also includes a vertical post spaced from the block and adapted to releasably receive the nock end of the arrow to assure proper positioning of the fletch on the arrow shaft. The block may have a grooved upper surface to support and align the fletch bridge and shaft, and/or may have diverging sidewalls to align and support the vanes during fletching. The block upper surface, with or without groove, may be inclined down towards the post to facilitate holding of the shaft in the proper position. One or more straps or the like may press the shaft against the bridge on the block's upper surface.

The result is a fletching jig which is simple to make, use and repair, inexpensive, durable and highly efficient. When used with multi-vane fletchs, the fletching time is greatly reduced. Moreover, precisely the same fletching with exactly the same position of the vanes on the shaft can be easily achieved from arrow to arrow, so that the arrows as fletched are uniform and highly accurate. Further features are set forth in the following detailed description and accompanying drawings.

DRAWINGS

FIG. 1 is a schematic perspective view of a first preferred embodiment of the improved fletching jig of the present invention;

FIG. 2 is a schematic top plan view of a two vane-fletch utilizable with the jig of FIG. 1;

FIG. 3 is a schematic cross section of a pair of the two-vane fletches of FIG. 2 on an arrow shaft;

FIG. 4 is a schematic fragmentary side elevation of the jig of FIG. 1 with the fletch of FIG. 2 in place on an arrow shaft;

FIG. 5 is a schematic fragmentary top plan view of the jig of FIG. 4;

FIG. 6 is a schematic cross-section taken along the section line 6—6 of FIG. 4;

DETAILED DESCRIPTION

FIGS. 1–6

Figure 9:
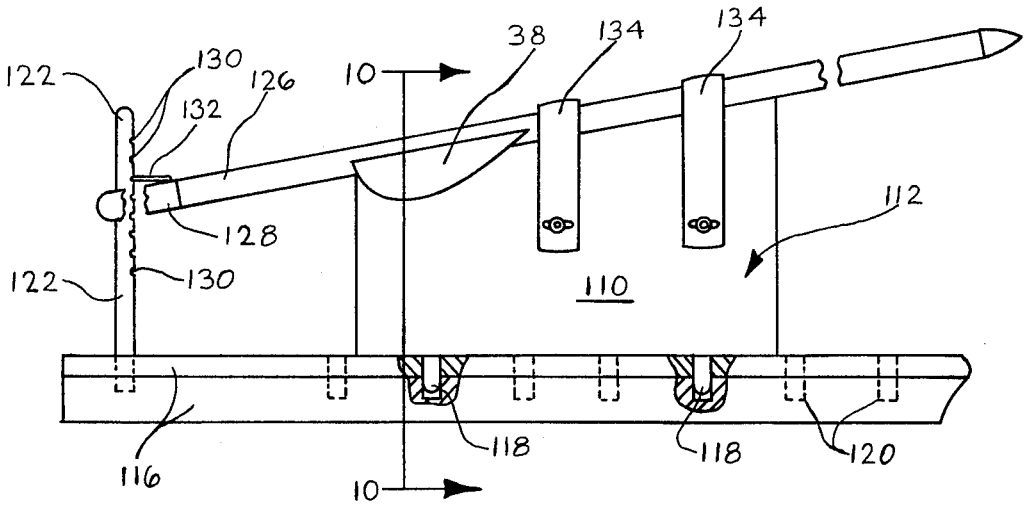
FIG. 9 is a schematic fragmentary side elevation of a third preferred embodiment of the improved fletching jig of the present invention, shown with an arrow shaft being fletched therein; and, FIG. 10 is a schematic cross-section taken along the section line 10—10 of FIG. 9.

Now referring more particularly to FIGS. 1, 4 and 5, a first preferred embodiment of the improved fletching jig of the present invention is schematically depicted therein. Thus, a fletching jig 20 is shown which comprises an upstanding elongated jig block 22 secured (FIG. 4) as by one or more screws 24, to a flat elongated base support 26. Support 26 may, in turn, be secured, as by screws 28 through apertures 30, to a suitable substrate 32 (FIG. 4). Jig 20 also includes a fixed vertical post 34 spaced from one end of block 22.

Support 26 has a narrow longitudinal slot 35 therein (FIG. 1) up through which screw 24 (secured to support 26) passes into block 22 (FIG. 4). Thus block 22 can be moved longitudinally along slot 35 toward and away from post 34 a desired distance to properly space post 34 and block 22 for fletching purposes, as more particularly described hereinafter. Tightening of screw 24 can temporarily lock block 22 in a desired position along support 26.

The configuration of block 22 is especially adapted to facilitate fletching of multi-vaned fletches, particularly two-vaned fletches, such as fletch 36 of FIG. 2. Fletch 36 comprises a pair of elongated vanes 38 separated by a longitudinally extending central bridge 40. A pair of fletches 36 are dimensioned and configured to be connected, as shown in FIG. 3, to an elongated cylindrical arrow shaft 42, which may be of solid wood, or may be hollow (as shown) and of metal, such as aluminum or steel, or of fiberglass, graphite or a mixture of fiberglass and graphite, or the like. For target purposes, hollow tubular arrows are usually used. As will be noted from FIG. 3, each fletch 36 is connected to shaft 42 by its bridge 40. The two bridges 40 are on opposite sides of shaft 42 and curve around and are bonded to shaft 42 as by cement, etc., (not shown). In their bonded position shown in FIG. 3, bridges 40 cause the vanes 38 connected thereto to assume a uniform reproducible angle from each other and from shaft 42. Thus, the four vanes 38 are symmetrically disposed around shaft 42 for efficient arrow flight.

Each fletch 36 can be affixed to shaft 42 most advantageously utilizing jig 20. In this regard, the upper surface 44 of block 22 may be provided along its entire length with a groove 46 which may be curved, that is, is generally semi-circular in cross-section and within which shaft 42 and bridge 40 can be nested, as shown particularly in FIG. 6. Moreover, upper surface 44 and groove 46 of block 22 are inclined down towards post 34 to facilitate alignment and abuting of shaft 42 against post 34. Finally, sidewalls 54 of block 22 diverge from groove 52 down to their base at an angle equal to the proper angle of divergence between vanes 38 of a fletch 36, so as to support the same for fletching (FIG. 6).

When it is desired to apply fletch 36 to shaft 42, the spacing between post 34 and block 22 is adjusted as previously described, so that fletch 36 when aligned on block 22 at the end closest to post 34 will be at the proper location on shaft 42. The rear end 48 of shaft 42 to which a plastic, metal, wood or other type of string nock 50 has been applied, is then releasably positioned against post 34, so that the string groove 52 of nock 50 receives post 34 (FIG. 5) and cannot move rearwardly or laterally. It will be understood that the front portion of shaft 42, with its point attached (not shown) may extend sufficiently far beyond block 22, relative to the portion of shaft 42 between post 34 and block 22, and be sufficiently heavy so that it tends to dip towards base support, causing the rear portion of shaft to tend to rise above the level of block along post 34. This rising is prevented by a knurled turn knob 56 threadably received on post 34. For the fletching operation knob 56 is adjusted on post 34 to cause knob 56 to abut an upper surface of nock 50 to hold shaft 42 firmly in place vertically, as shown in FIG. 4. Shaft 42 can then be temporarily slipped off of block 22.

The upper surface of a first fletch bridge 40 is then coated with a bonding agent before or after first fletch 36 is disposed in groove 46 and over sidewalls 54, as shown in FIG. 6, at the end of block 22 adjacent post 34. Fletch 36, when in the position shown in FIG. 6, is properly aligned for full engagement of bridge 40 with shaft 42 for maximum bonding. The nock 50 of shaft 42 is then re-engaged with post 34 and shaft 42 is forced into contact with coated bridge 40 (FIG. 6) and held in that position until the bonding agent sets. Shaft 42 with fletch 36 thereon is then removed from block 22, after which the process is repeated. Thus, a second fletch 36 is placed on block 22 in the same position as previously occupied by the first fletch 36, the exposed surface of bridge 40 thereof is coated with bonding agent and shaft 42 is re-engaged, as previously described, with post 34 and with coated bridge 40. This time, however, the opposite side of shaft 42 is used, so that the finished fletched configuration is that illustrated in FIG. 3. After the bonding agent has set, the finished fletched shaft 42 is removed from block 42 and is ready for use.

Jig 20 has the advantage of being simple, inexpensive to manufacture, and easy to use. Since two vanes are fletched at one time, fletching proceeds smoothly and jig 20 can be adjusted precisely as to positioning of fletches 36 on shaft 42 so that each shaft 42 can be fletched precisely the same, providing improvements in arrow flight accuracy. Blocks 22 of various sizes can be substituted on support 26, as desired, to accommodate various diameter sizes of arrow shafts, although several such sizes of shafts can be fletched on a block 22 of a given size. A fletch 36 of a single size can also be used on a number of sizes of shafts. Fletches 36 of various sizes can be used with a given size of block 22. Therefore, jig 20 is very adaptable.

Figure 8:
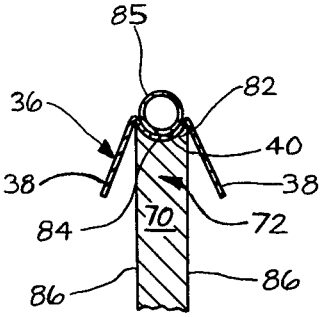
FIG. 8 is a schematic cross-section taken along the section line 8—8 of FIG. 7.
Figure 7:
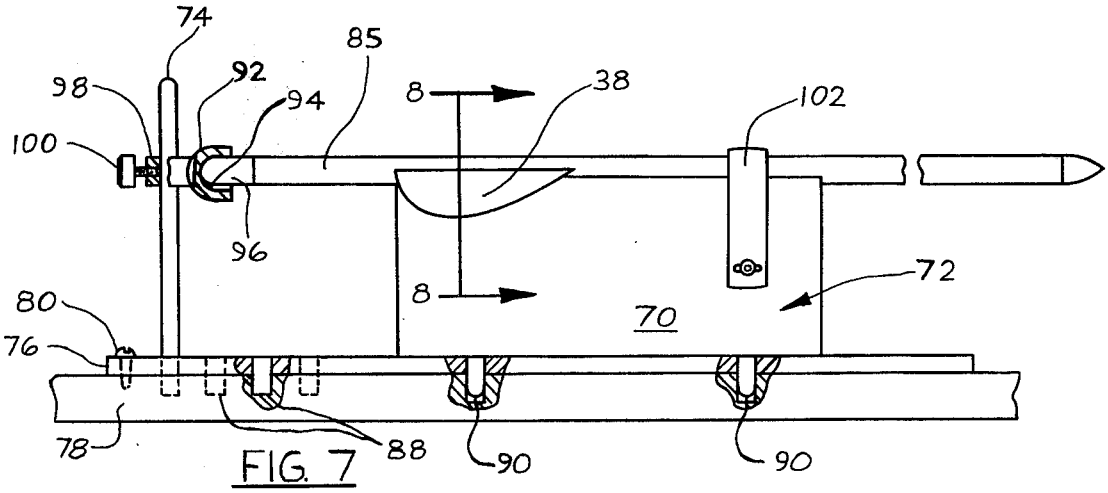
FIG. 7 is a schematic fragmentary side elevation of a second preferred embodiment of the improved fletching jig of the present invention, shown with an arrow shaft being fletched.

FIGS. 7 and 8

A second preferred embodiment of the improved fletching jig of the invention is schematically depicted in FIGS. 7 and 8. Thus, a jig 70 is shown which includes an upstanding elongated block 72 spaced from an upstanding post 74. Both block 72 and post 74 are secured to an elongated base support plate 76 and plate 76 is, in turn, secured to a substrate 78, as by one or more screws 80. Block 72 has a generally horizontal upper surface 82 bearing a longitudinal horizontal groove 84 therein. Preferably, groove 84 is about semi-circular in cross-section and is adapted to support an arrow shaft 85 therein. The sidewalls 86 of block 72 are vertical. Post 74 is moveable in location while block 72 is fixed in location relative thereto. Thus, substrate 78 includes a plurality of vertical apertures 88 spaced along the length thereof and adapted to receive the bottom end of post 74 and also spaced vertical pegs 90 secured to the underside of block 72. Moreover, post 74 can be lifted from support 76 and relocated in any of the apertures 88 which are external of block 72. Thus, post 74 can be moved closer to or farther from block 72.

Post 74 bears a cup 92 having a cavity 94 facing block 72. Cavity 94 is adapted to receive the rear end of nock 96 on shaft 85. Cup 92 is secured to a ring 98 which is releasably secured by a screw 100 to post 74 so that the vertical position of cup 92 can be adjusted so as to properly hold shaft 85 for fletching on block 72. Cavity 94 may have a protrusion or blade (not shown) to engage the string groove (not shown) of nock 96 in order to assure proper longitudinal positioning of shaft 85. A flexible strap releasably pinned to opposite sides 86 of block can be used to hold shaft 85 in place on block 72 during the fletching operation.

The fletching procedure with jig 70 is generally the same as described for jig 20. Thus, the desired spacing between block 72 and post 74 is selected and post 74 is positioned accordingly. The heighth of cup 92 on post 74 is also adjusted to hold shaft 85 securely against pivoting away from block 72 when placed on block 72. Fletch 36 is then arranged on surface 82 of block 72, as shown in FIG. 8, the top surface of bridge 40 thereof is coated with bonding agent, and then shaft 85 is properly positioned thereover with nock 96 engaging cup 92. Lastly, strap 102 is secured over shaft 85, as shown in FIG. 7, to press shaft 86 against bridge 40 and assure proper bonding thereto. After the bond is complete, a second fletch 36 is bonded to the opposite side of shaft 85 by the same procedure, utilizing the same cup and post positions, to provide a finished precisely fletched product. Accordingly, jig 70 has essentially the advantages of jig 20.

Figure 10:
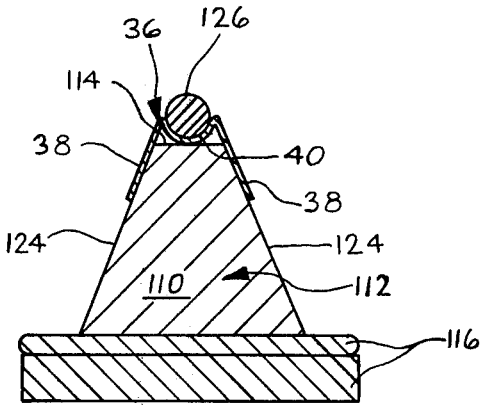

FIGS. 9 and 10

A third preferred embodiment of the jig of the invention is set forth schematically in FIGS. 9 and 10. Thus, a jig 110 is shown which includes a block 112 which has an inclined grooveless upper surface 114 and is releasably secured to a base support plate 116 by depending pegs 118 in apertures 120 in support 116. A sufficient number of apertures 120 are provided along the length of support 116 to enable block 112 to be repositioned relative to a fixed vertical post 122 adjacent one end of support 116. Surface 114 is inclined down towards post 122. Block 112 has sidewalls 124 which diverge from upper surface 114, as shown in FIG. 10, the angle of divergence matching the proper angle of divergence between vanes 38 of fletch 36 when fletch 36 is to be applied to arrow shaft 126. Since surface 114 has no groove therein which permits bridge 40 to be pressed therein by shaft 126 so as to fit closely around shaft 126 during bonding of fletch 36 to shaft 126, the diverging sidewalls 124 are needed to diverge vanes 38 sufficiently to cause bridge 40 to closely fit around shaft 126. Thus, either diverging sidewalls such as sidewalls 124 are required, or a groove in the upper surface 114 of block 112 is required.

The rear end of shaft 126 bears a nock 128 having a string groove (not shown) into which post 122 is engaged to position shaft 126 longitudinally. To prevent nock 128 from sliding up post 122, post 122 has a plurality of vertically spaced apertures 130 and a horizontally extending pin 132 disposable therein. The proper aperture 130 is selected for pin 132 so that pin 132 bears on the upper surface of nock 128 and keeps shaft 126 flush on surface 114.

When fletching shaft 114, the same procedure is used as described above. Thus, necessary positional adjustments are made for pin 132 and block 112. Fletch 36 is then placed on the end of block 112 facing post 122 and bonding agent is applied to the exposed surface of bridge 140. Nock 128 is then engaged with post 122 and the underside of pin 132, whereupon shaft 126 is placed on bridge 140 (FIG. 10) and releasably strapped down tight, as by spaced straps 134 releasably pinned to sidewalls 124. Shaft 126 is left in place until the bonding agent sets, whereupon shaft 126 is removed, and a second fletch 36 is applied to the opposite side of shaft 126 in the same manner as just described.

Jig 110 has substantially the same advantages as jigs 20 and 70. All three jigs 20, 70 and 110 can be fabricated of wood, metal, plastic, fiberglass or the like. Moreover, various modifications and additions can be made in the jigs of the invention and in the components thereof. All such modifications and additions as are within the scope of the appended claims form part of the present invention.

What is claimed is:

1. An improved arrow fletching jig for use with a multi-vane fletch having a bridge between adjacent vanes, said jig comprising, in combination:

a. an upstanding jig block having sidewalls and an upper surface, the latter being adapted to support an arrow shaft and the bridge of a multi-vane fletch against said shaft for proper bonding and fletching;

b. an upstanding nock post spaced from said block, said post including means for releasably receiving the nock of an arrow when the shaft of said arrow is on said block;

c. means for releasably securing an arrow shaft to said block and for facilitating the joining of said fletch bridge to said shaft; and, d. a base support to which said block is secured and defining a plurality of vertical apertures adapted to receive the lower end of said post, said apertures being spaced along the longitudinal axis of said block but external of said block, whereby the spacing between said block and post can be varied.

2. An improved arrow fletching jig for use with a multi-vane fletch having a bridge between adjacent vanes, said jig comprising, in combination:

a. an upstanding jig block having sidewalls and an upper surface, the latter being adapted to support an arrow shaft and the bridge of a multi-vane fletch against said shaft for proper bonding and fletching;

b. an upstanding nock post spaced from said block, said post including means for releasably receiving the nock of an arrow when the shaft of said arrow is on said block, said nock-receiving means being vertically repositionable on said post;

c. means for varying the spacing between said post and block; and, d. means for releasably securing an arrow shaft to said block and for facilitating the joining of said fletch bridge to said shaft.

3. The improved jig of claim 2 wherein said nock-receiving means comprises a knob threaded on said post.

4. The improved jig of claim 2 wherein said nock-receiving means comprises a cup releasably pinned to said post.

5. An improved arrow fletching jig for use with a multi-vane fletching having a bridge between adjacent vanes, said jig comprising, in combination:

a. an upstanding jig block having sidewalls and an upper surface, said upper surface being adapted to support an arrow shaft and the bridge of a multi-vane fletch against said shaft for proper bonding and fletching;

b. an upstanding nock post spaced from said block, said post including means for releasably receiving the nock of an arrow when the shaft of said arrow is on said block, said jig block upper surface being inclined down towards said post to facilitate securing of said nock at said post;

c. means for varying the spacing between said post and block; and, d. means for releasably securing an arrow shaft to said block and for facilitating the joining of said fletch bridge to said shaft.

6. An improved arrow fletching jig for use with a multi-vane fletch having a bridge between adjacent vanes, said jig comprising, in combination:

a. an upstanding jig block having sidewalls and an upper exposed surface with an arrow shaft-supporting exposed longitudinal groove therein, said surface being adapted to support the bridge of a multi-vane fletch against said shaft for proper bonding and fletching;

b. an upstanding nock post spaced from said block, said post including means for releasably receiving the nock of an arrow when the shaft of said arrow is on said block;

c. means for varying the spacing between said post and block; and, d. means for releasably securing an arrow shaft to said block and for facilitating the joining of said fletch bridge to said shaft.

7. The improved jig of claim 6 wherein said block has downwardly diverging sidewalls, wherein the angle of divergence of said sidewalls about matches that of two adjacent vanes of a multi-vane fletch containing a bridge between adjacent vanes and adapted to be fletched on said jig, when said vanes are properly aligned with an arrow shaft, whereby said sidewalls are adapted to properly align and support said two adjacent vanes in relation to said shaft while the bridge between said vanes lies on said upper surface and abuts the outer surface of said shaft and while said shaft lies on said bridge.

8. The improved jig of claim 7 wherein said fletch is a two-vane fletch, and wherein said nock-receiving means is vertically adjustable on said post.

9. The improved jig of claim 6 wherein said groove is about semi-circular in cross-section and fully exposed.

10. The improved jig of claim 9 wherein said upper surface and said groove are inclined down towards said post.

* * * * *